US007564989B2

(12) United States Patent
Schanz

(10) Patent No.: US 7,564,989 B2
(45) Date of Patent: Jul. 21, 2009

(54) CONCHA BOWL HEARING AID APPARATUS AND METHOD

(75) Inventor: Richard W. Schanz, St. George, UT (US)

(73) Assignee: Schanz II, LLC, St. George, UT (US)

( * ) Notice: Subject to any disclaimer, the term of this patent is extended or adjusted under 35 U.S.C. 154(b) by 483 days.

(21) Appl. No.: 11/604,128

(22) Filed: Nov. 24, 2006

(65) Prior Publication Data

US 2008/0123888 A1 May 29, 2008

(51) Int. Cl.
*H04R 25/00* (2006.01)

(52) U.S. Cl. ..... 381/328; 381/322; 381/380

(58) Field of Classification Search ..... 381/322, 381/324, 326, 328, 329, 330, 380, 382; 181/129, 181/130, 135

See application file for complete search history.

(56) References Cited

U.S. PATENT DOCUMENTS 3,676,611 A 7/1972 Stephens
4,375,016 A 2/1983 Harada
5,048,092 A 9/1991 Yamagishi et al.
5,201,007 A * 4/1993 Ward et al. ..... 381/328
5,920,635 A * 7/1999 Lenz ..... 381/328
6,021,207 A 2/2000 Puthuff et al.
6,275,596 B1 8/2001 Fretz et al.
7,421,086 B2 * 9/2008 Bauman et al. ..... 381/328
2003/0165248 A1 9/2003 Lenz et al.
2004/0218772 A1 11/2004 Ryan
2006/0023908 A1 2/2006 Perkins et al.
2006/0045297 A1 3/2006 Haussmann
2006/0147072 A1 7/2006 Sodoma et al.

* cited by examiner

*Primary Examiner*—Huyen D Le
(74) *Attorney, Agent, or Firm*—Marcus G. Theodore

(57) ABSTRACT

A method and in the concha bowl hearing aid apparatus with sound processor/amplifier and speaker sized to be removably secured within the concha bowl of the ear and structured to allow sound to pass through the hearing aid into the ear canal so its speaker positioned within the external auditory canal of the ear blends and provides the desired combination of external sound entering the ear canal with amplified sound from the speaker.

10 Claims, 2 Drawing Sheets

CONCHA BOWL HEARING AID APPARATUS AND METHOD

BACKGROUND OF THE INVENTION

1. Field of Invention

The present invention relates to hearing aids. In particular, it relates to an improved hearing aid and method that employs an in the concha bowl hearing aid structured to allow sound to pass into the ear canal to be combined with amplified sound from the hearing aid microphone inserted within the opening of the ear canal and sized not to obstruct the same.

2. Description of Related Art

Various hearing aids and earpiece devices are known in the art. Sodoma et al, U.S. Publication No. 2006/0147072A1 published Jul. 6, 2006 provides an open in the pinna of the ear hearing aid with its exterior components placed in and around the pinna connected to an interior in the canal section output port for emission of sounds with a short vent 22 to prevent occlusion (Claim 1, last line) so that the ear canal is at least partially open for directly receiving amplified sounds. It requires molding of both the exterior components as well as the canal components for proper fitting. It also is not designed to send natural sounds into the ear canal for admixing with the amplified sounds.

Lenz et al, U.S. Publication No. 2003/01652487A1 published Sep. 4, 2003, discloses a hearing aid adapted to be inserted within the auditory meatus of the user's ear. It includes passages for ventilation, but is not designed for allowance of natural sound transmission. Instead it employs sound-dampening material to prevent exterior sound interference with the amplified loudspeaker output into the ear canal.

Harada, U.S. Pat. No. 4,375,016B1 issued Feb. 22, 1983 discloses a vented ear tip for a hearing aid and adapter coupler mounted within the bowl of the ear as a multiple standard sized fitted earpiece with a vented ear tip is adapted for insertion into the external auditory canal of a user. The device requires a number of different sized in the bowl hearing aids to be available, which are then attached a tight sealed coupler inserted into the opening and in the auditory canal (col. 2, line 52-3), which blocks natural sounds from entering the ear canal.

Perkins et al, U.S. Publication No. 2006/002398A1 published Feb. 2, 2006 discloses a custom fitted transducer for activating a surgically implanted magnet affixed to an acoustic member (page 3, col. 2, last lines) to produce electromagnetic hearing (page 3, col. 2, lines 9-19).

Haussmann, U.S. Publication No. 2006/0045297A1 published Mar. 2, 2006 discloses another fitted earplug (page 3, col. 2, lines 9-12) worn in the ear that fills the entire ear canal of a user and may extend to the outer ear bowl of a user.

Lenz, U.S. Pat. No. 5,920,635 issued Jul. 6, 1999, discloses a hearing aid configured to be placed in the inlet of the external auditory meatus. A passage transmits sound waves picked up and treated by the auricle to the microphone 22 (Col 4, lines 11-13), but exterior natural sounds are blocked via sound dampening material forming a closed fit when the hearing aid is inserted.

Ryan, U.S. Publication No. 2004/0218772A1 published Nov. 4, 2004 discloses a hearing aid earpiece worn in the ear and a sound amplifier worn externally of the ear. It is removeably mounted within the ear canal with a vent tube, which reduces sound radiation from the vent opening using a passive structure (page 2, second column, lines 20-23) to provide feedback attenuation (page 3, first column, lines 32-33).

Stephens, U.S. Pat. No. 3,676,611, issued Jul. 11, 1972, is an earpiece for hearing aids having sound inlets for high frequencies. The earpiece collects sounds, sends them via a conduit to the amplifier for amplification, and then transmittal to the inner ear via another conduit in the earpiece. (Col 1, lines 32-44).

Yamagishi et al, U.S. Pat. No. 5,048,092 issued Sep. 10, 1991 is an electro acoustic transducer apparatus that is inserted into the cavum concha. It has an in-the ear type of headphone provided with an air passage portion so that a certain amount of sound escapes to the outside to obtain acoustic characteristics of substantially the same level from a low band to a high band (Abstract).

Fretz et al, U.S. Pat. No. 6,275,596B1 issued Aug. 14, 2001 discloses an open ear canal hearing aid system with the speaker positioned in the ear canal leaving it partially open.

Cited for general interest is Posthuff et al, U.S. Pat. No. 6,021,207B2 issued Feb. 1, 2000 discloses wireless open ear canal earpiece.

None of the above references provides a hearing aid positioned within the concha bowl of the ear, which provides an open ear canal hearing aid system wherein natural sound is blended with amplified sound to provide a more natural combined sound. Nor are special ear molds required by an audiologist.

SUMMARY OF THE INVENTION

The present invention comprises a removable in the concha bowl hearing aid having a housing with an interior and exterior sized to fit within the concha bowl of the outer ear. The concha bowl and other sound funneling structure of the outer ear are shown in FIG. 1—the Helix, Scapha, Tossa Trianguularis, Concha, Anti-Helix, Tragus, Anti-Tragus, and Lobule. The housing is structured to define at least one opening such as a vent, channel, or passageway in communication with the ear canal when positioned in the concha to allow sound to pass through the housing into the ear canal. In one preferred embodiment, the opening is located along the perimeter of the housing and is as large as possible to allow more natural sound to pass into the ear canal.

A microphone is attached to the exterior surface of the housing in a position when inserted within the concha bowl of the exterior ear to pickup sound focused by the sound funneling structure of the outer ear. The microphone than transfers electronic impulses via wire leads or a wireless connection to a sound processor/amplifier associated with a battery mounted within the interior of the housing.

The in the concha bowl hearing aid is held in place with at least two supports. The first bendable support is bent to removably secure to the fold of the inner ear canal proximate its opening. A preferred first bendable support attached to the housing is formed from bent wire leads in communication with and supporting a speaker to be located in the ear canal. These wire leads are attached to the exterior surface of the housing facing toward the inner ear, when inserted. The wire leads have a first end attached to and operably associated with the sound processor/amplifier and a second end. This first bendable support has its wire leads bent to form secure a segment against an interior wall fold proximate the ear canal opening as a first contact point to support the housing in position when inserted. Its other end is positioned so that the wire second end is directed toward the inner ear. This first bendable wire support is made of plastic, nylon, or other fluid resistant materials covered electrical wiring, which may be bent to hold its shape.

A speaker is attached to the wire second end of the first bendable support. The speaker and first bendable support are sized and positioned to fit within and partially obstruct the interior ear canal to allow air and sound to flow there through and direct amplified sound toward the inner ear. Thus positioned, it directs amplified sound for admixing and blending with natural sound entering the ear canal to minimize echoes and provide more natural sound pick up and transmission.

At least one second support is attached to the housing opposite the first bendable support. A preferred second support comprises a plastic retainer rod inserted into one of a series of holes in the perimeter of the housing. It is cut to length to act as an additional anchor to secure the hearing aid into the concha bowl of the ear.

This second support is structured and adapted to secure the housing within the concha bowl of the ear canal by providing a second contact point generally opposite the first contact point. As the exterior of the housing also contacts the concha, usually only one second support is required. However, additional supports associated with the housing, are included as required to assist in further securing the in the concha bowl hearing aid within the concha bowl of the ear.

If external feedback is a problem, the in the concha bowl hearing aid may include filters, such as a feedback compensation circuit associated with the amplifier to compensate for feedback signals and other interference. Other adaptive filters well known in the art that change impulse responses or compensate for static or out of phase interference may also be incorporated, if required.

The in the concha bowl hearing aid includes a power switch associated with the sound processor/amplifier and battery to turn the hearing aid on in one mode, and off in another mode. This not only conserves power drain, but allows the device to be shut off for use of the telephone.

Preferably, the speaker includes a wax cap to prevent its obstruction.

The housing design thus does not have to be individually fitted, reducing manufacturing cost and fitting time. The method of using an in the concha bowl hearing aid comprises first placing in the outer ear concha bowl an in the concha bowl hearing aid. As the housing is sized to fit within the outer ear concha bowl of the ear leaving an opening in communication with the ear canal, sound is allowed to pass through the housing into the ear canal.

The microphone attached to the exterior surface of the housing is positioned to pickup sound focused by the sound funneling of the outer ear structure, when inserted. The microphone converts sound into electronic impulses transferred via wires or other wireless electronic means to a sound processor/amplifier associated with a battery mounted within the interior of the housing, The first bendable support affixed to the housing is then bent, fitted, and positioned against an interior wall fold of the ear canal opening to provide a first contact point for supporting the housing in position when inserted. The end of the first bendable support with the speaker attached is pointed toward the inner ear so that both fit within and partially obstruct the interior ear canal to allow air and sound to flow there through. The positioned speaker, when activated, directs amplified sound toward the inner ear for admixing and blending with natural sound entering the ear to minimize echoes and provide more natural sound pick up and transmission.

At least one second support attached to the housing opposite the first support is then adapted to secure the housing within the concha bowl of the ear canal by providing a second opposite contact point. The bendable supports are generally fitted in one visit to an audiologist to secure the hearing aid within the concha bowl and hold the speaker in position within the external auditory canal of the ear.

After the in the concha bowl hearing aid is fitted, it is then electively activated to combine external sound entering the ear canal with amplified sound from the speaker. If feedback or static is a problem, the in the concha bowl hearing aid filters associated with the amplifier are adjusted to compensate for feedback signals and other interference. These filters are selectively adjusted to provide the desired combination of external sound entering the ear canal with amplified sound from the speaker.

The present invention is therefore particularly adapted to provide an easily fittable in the bowl hearing aid with a speaker placed within an unobstructed ear canal to provide more natural combination amplified and natural sound pick up and transmission.

DESCRIPTION OF THE ILLUSTRATED EMBODIMENTS

Figure 1:
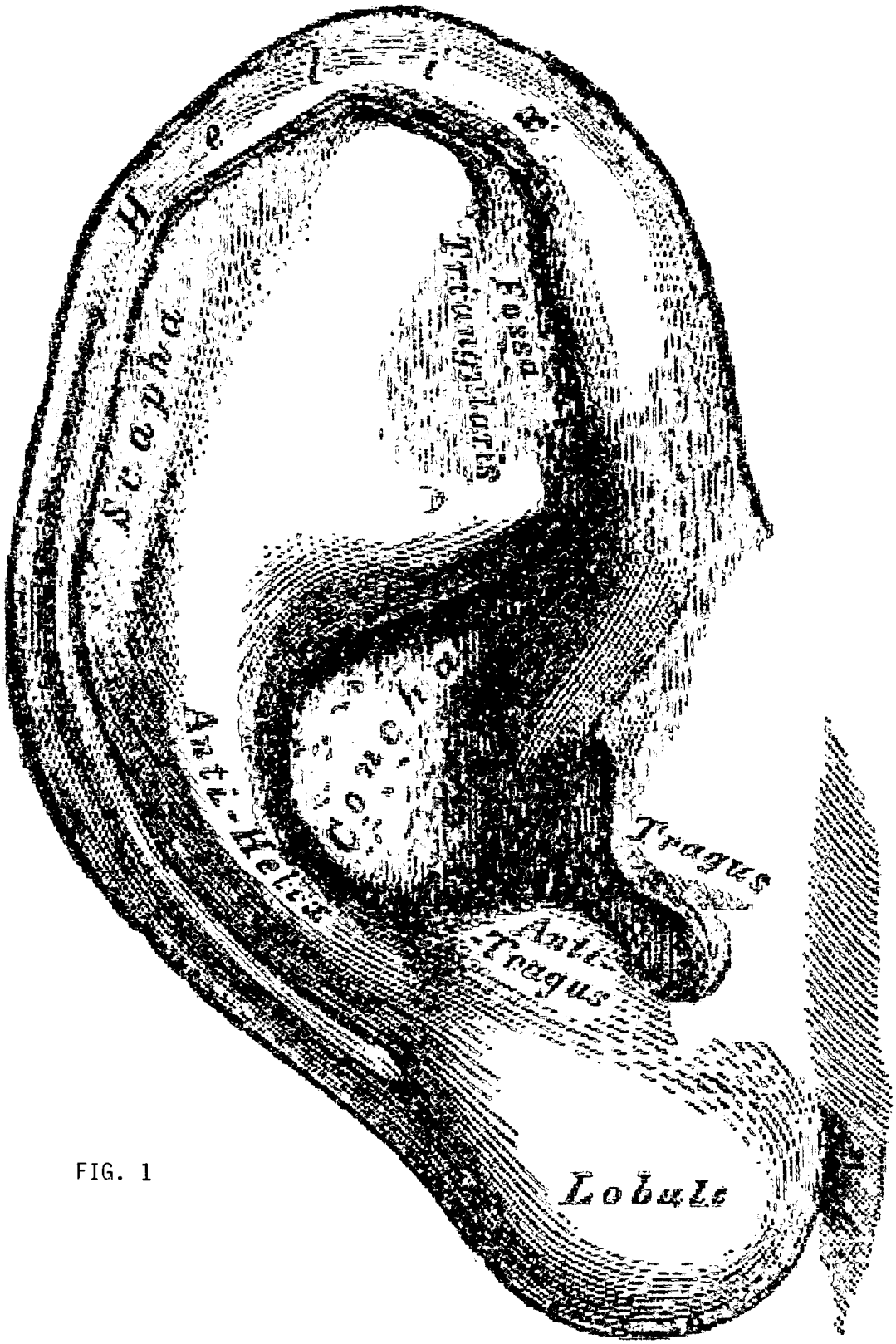
FIG. 1 is a side view of the structure of the exterior of an ear.
Figure 2:
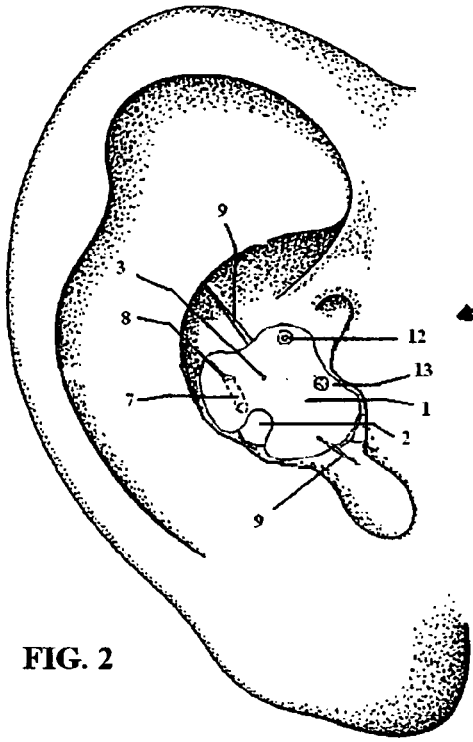
FIG. 2 is a side view of a preferred embodiment of the invention positioned on an ear.
Figure 4:
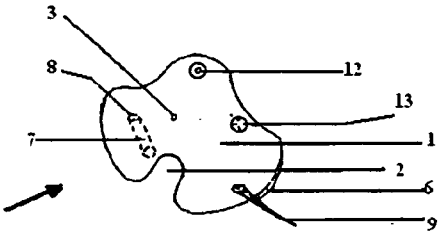
FIG. 4 is a front view of the embodiment shown in FIG. 2.
Figure 3:
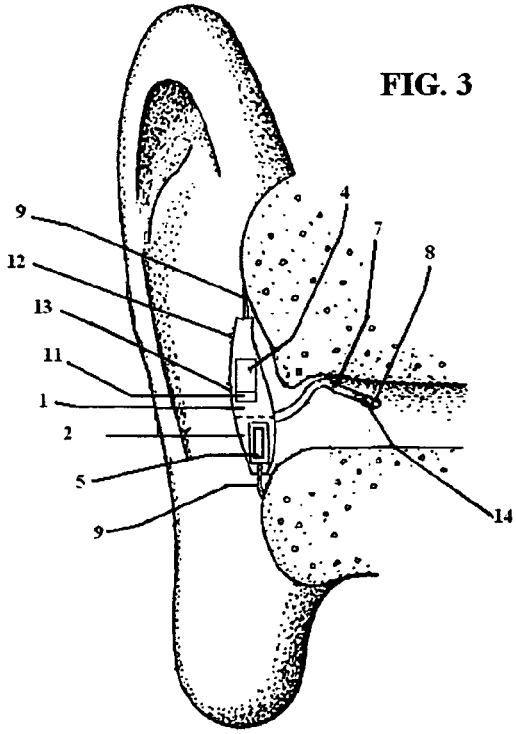
FIG. 3 is a cross sectional view of the embodiment of FIG. 2 positioned with the speaker in the ear canal.

The in the concha bowl hearing aid 10 is shown in the attached drawings. FIGS. 2 and 3 are front and side views of a preferred embodiment of the invention positioned on a wearer's right ear. The invention comprises a housing 1 with an interior and exterior sized to fit within the outer ear concha bowl. The housing 1 has a perimeter opening 2 when positioned in the bowl of the ear in communication with the ear canal to allow sound to pass through the housing 1 into the ear canal.

A microphone 3 is attached to the exterior surface of the housing 1 positioned to pickup sound focused by the sound funneling structure of the outer ear. The microphone 3 picks up the sound, changes it into electronic impulses, which are sent to a sound processor 4 associated with a battery 5 shown in FIG. 5 mounted within the interior of the housing 1. The battery 5 is inserted and interchanged in the interior of the housing 1 via a door 6. The door 6 is placed on the rear lower side of the housing 1 to minimize the possibility of moisture and perspiration from entering the unit.

The sound wire 7 leading from the sound processor 4 to a speaker 8 acts as a first bendable support and is attached to the exterior surface of the housing facing toward the inner ear, when inserted. The sound wire 7 holds its position, when bent. It is fitted and positioned against an interior wall to removably hook against the inner fold of the ear canal proximate its opening as a first contact point to support the housing 1 in position when inserted. The other end of the wire 7 is directed toward the inner ear to align the speaker 8. The speaker 8 and sound wire 7 are sized and positioned to fit within and partially obstruct the interior ear canal to allow air and sound to flow there through. The natural sound is combined with amplified sound to minimize echoes and provide more natural sound pick up and transmission.

Figure 5:
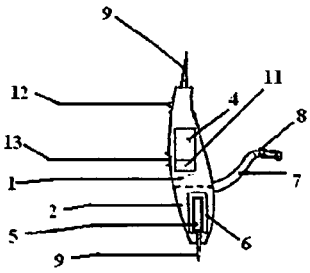
FIG. 5 is a side view of the embodiment shown in FIG. 2.

At least one second plastic rod support 9 is attached to the housing 1 and cut to length opposite the first wire 7 bendable support. It is adapted to secure the housing 1 within the concha bowl of the ear canal by providing a second opposite contact point. Additional rod supports 9 may be included as shown in FIGS. 2, 3, and 5 to provide multiple point contacts for more secure anchoring where vigorous use is anticipated. A preferred embodiment of a bendable support 9 is a plastic retainer comprising a slender plastic rod, which can be cut to length and inserted in the plurality of holes (not shown) at desired points to provide the necessary anchoring. These plastic retainers 9 are friction fitted or glued into the holes.

Filters 11 shown in FIG. 3 may be associated with the sound processor amplifier 4 to compensate for feedback signals, static, and other interference.

The exterior of the housing 1 includes a power switch 12 associated with the sound processor amplifier 4 and battery 5 to turn the hearing aid on in one mode, and off in another mode to conserve battery life and facilitate telephoning. It also includes a volume control 13 so the wearer has complete control over the amount of amplification for maximum listening comfort.

Preferably, the hearing aid speaker 8 includes a wax cap 14 shown in FIG. 3 to prevent obstruction.

The invention thus provides a new in the ear concha bowl hearing aid 10 with periphery openings 2 to provide channels leading into the ear canal, which allows the wearer to hear more natural sounds. The hearing aid is thus structured to fit entirely within the concha bowl of the ear without fully obstructing the ear canal opening. More natural hearing is accomplished when the sounds pass through the perimeter opening 2 in the body 1 of the in the concha bowl hearing aid 10. The sounds are supplemented and further amplified by amplified sounds from a speaker 8 positioned within the ear canal to direct combined sounds onto the inner ear. This employment of combination natural and amplified sound provides a more natural hearing system and method.

The above description and specification should not be construed as limiting the scope of the appended claims. The claims themselves recite those features deemed essential for the invention.

I claim:

1. An in the concha bowl hearing aid comprising:

a. a housing with an interior and exterior sized to fit within the outer ear concha bowl, and defining at least one opening in communication with the ear canal to allow external natural sound to pass through the housing into the ear canal, b. a microphone attached to the exterior surface of the housing positioned to pickup sound focused by the sound funneling of the outer ear and translate sound into electronic impulses when the housing is placed in the concha bowl, c. a sound processor with an amplifier located within the housing interior in communication with the microphone to receive electronic impulses, d. a battery mounted within the interior of the housing operably associated to power the sound processor, amplifier, microphone, and a speaker, e. a first bendable support with first and second ends sized and positioned to fit within and partially obstruct the interior ear canal to allow air and sound to flow there through, the first end attached to the exterior surface of the housing and the second end structured to removably secure to a fold in the wall of the ear channel proximate its exterior opening, when inserted, f. electronic means associated with the bendable support to transfer electronic signals from the sound processor and amplifier, g. a speaker attached to the second end of the bendable support operably associated with the sound processor and amplifier by the electronic means to receive electronic signals and convert them to amplified sound for direction toward the inner ear for admixing and blending with natural sound entering the ear to minimize echoes and provide more natural sound pick up and transmission, and h. at least one second support attached to the housing opposite the first bendable support adapted to secure the housing within the concha bowl of the ear canal by providing opposite contact points.

2. An in the concha bowl hearing aid according to claim 1, wherein the first bendable support and electronic means comprise wire leads attached to the housing in communication with the sound processor and amplifier and speaker, bent to position a segment of the wire leads against an interior wall fold of the ear canal proximate the opening as the first contact point to support the housing in position when inserted.

3. An in the concha bowl hearing aid according to claim 1, including filters associated with the sound processor and amplifier to compensate for feedback signals and other interference.

4. An in the concha bowl hearing aid according to claim 1, including a power switch associated with the sound processor and battery to turn the hearing aid on in one mode, and off in another mode.

5. An in the concha bowl hearing aid according to claim 1, wherein the speaker includes a wax cap to prevent obstruction.

6. A method of using an in the concha bowl hearing aid comprising:

a. placing in the outer ear concha bowl an in the concha bowl hearing aid with a sound processor/amplifier, microphone and speaker powered by a battery within a housing with an interior and exterior sized to fit within the outer ear concha bowl, defining at least one opening in communication with the ear canal to allow sound to pass through the housing into the ear canal; wherein the microphone is positioned on the exterior surface of the housing to pickup sound focused by the sound funneling structure of the outer ear, when the housing is inserted in the concha bowl, and convert sound into electronic impulses for transmission to a sound processor and amplifier; and the speaker is structured to direct amplified sound toward the inner ear for admixing and blending with natural sound entering the ear to minimize echoes and provide more natural sound pick up and transmission;

b. securing the hearing aid with a first bendable support with first and second ends sized and positioned to fit within and partially obstruct the interior ear canal to allow air and sound to flow there through, the first end attached to the exterior surface of the housing and the second end adapted to removably secure to a fold in the wall of the ear channel proximate its exterior opening, c. at least one second support attached to the housing opposite the first bendable support adapted to secure the housing within the concha bowl of the ear canal by providing opposite contact points, and d. selectively activating the in the bowl hearing aid to combine external sound entering the ear canal with amplified sound from the speaker.

7. A method of using an in the concha bowl hearing aid according to claim 6, wherein the first bendable support comprises wire leads in communication with the sound processor and amplifier and speaker, bent to position a segment of the wire leads against an interior wall of the ear canal as the first contact point to support the housing in position when inserted.

8. A method of using an in the concha bowl hearing aid according to claim 7, wherein the bendable support is structured to be generally fitted in one visit to an audiologist so that it is placed within the bowl to hold the speaker in position within the external auditory canal of the ear.

9. A method of using an in the concha bowl hearing aid according to claim 6, wherein the in the concha bowl hearing aid includes filters associated with the sound processor and amplifier to compensate for feedback signals and other interference.

10. A method of using an in the concha bowl hearing aid according to claim 9, wherein the filters are selectively adjusted to provide the desired combination of external sound entering the ear canal with amplified sound from the speaker.

* * * * *